United States Patent [19]

Zumeta

[11] Patent Number: 5,031,488

[45] **Date of Patent: * Jul. 16, 1991**

[54] COLOR CODING SYSTEM

[76] Inventor: Roberto G. Zumeta, 11206 Ivy Ridge Rd., Houston, Tex. 77043

[ * ] Notice: The portion of the term of this patent subsequent to Jun. 26, 2007 has been disclaimed.

[21] Appl. No.: 519,689

[22] Filed: Apr. 16, 1990

Related U.S. Application Data

[63] Continuation-in-part of Ser. No. 386,345, Jul. 28, 1989, Pat. No. 4,936,170.

[51] Int. Cl.[5] ..... B25B 13/58

[52] U.S. Cl. ..... 81/180.1; 81/DIG. 5; 116/335; 206/376

[58] Field of Search ..... 81/121.1, 119, 180.1, 81/DIG. 5; 116/335; 206/376-378

[56] References Cited

U.S. PATENT DOCUMENTS 1,719,077 7/1929 Ogsbury ..... 116/335

OTHER PUBLICATIONS

Jensen Fall Catalog, p. 104, "Hollow Shaft Nut Drivers", 1977.

Bahco Tools Catalog, p. 22, "Socket Wrench Sets", 5/22/86.

*Primary Examiner*—James G. Smith

*Attorney, Agent, or Firm*—Robert W. B. Dickerson

[57] ABSTRACT

A color coding system primarily for implements, including tools, instruments or other hand-manipulated devices, whereby individual colors are applied to tools of a series having diverse sizes, such diversity of size following an orderly scheme.

11 Claims, 1 Drawing Sheet

| SIZE | SHADE | COLOR | SIZE | SHADE | COLOR | SIZE | SHADE | COLOR |
|---|---|---|---|---|---|---|---|---|
| 1 MM. | LIGHT | YELLOW | 11 MM. | LIGHT | YELLOW | 21 MM. | LIGHT | YELLOW |
| 3 MM. | " | GREEN | 13 MM. | " | GREEN | 23 MM. | " | GREEN |
| 5 MM. | " | BLUE | 15 MM. | " | BLUE | 25 MM. | " | BLUE |
| 7 MM. | " | PINK | 17 MM. | " | PINK | 27 MM. | " | PINK |
| 9 MM. | " | GREY | 19 MM. | " | GREY | 29 MM. | " | GREY |
| SIZE | SHADE | COLOR | SIZE | SHADE | COLOR | SIZE | SHADE | COLOR |
| 2 MM. | DARK | YELLOW | 12 MM. | DARK | YELLOW | 22 MM. | DARK | YELLOW |
| 4 MM. | " | GREEN | 14 MM. | " | GREEN | 24 MM. | " | GREEN |
| 6 MM. | " | BLUE | 16 MM. | " | BLUE | 26 MM. | " | BLUE |
| 8 MM. | " | RED | 18 MM. | " | RED | 28 MM. | " | RED |
| 10 MM. | " | BLACK | 20 MM. | " | BLACK | 30 MM. | " | BLACK |

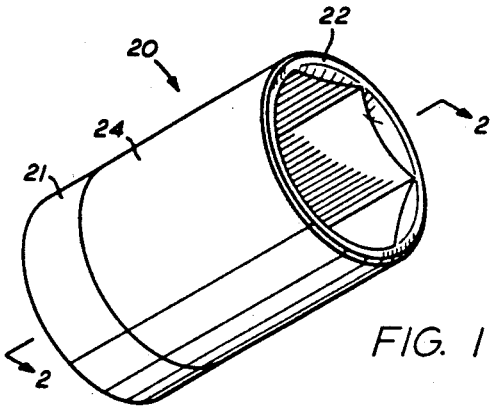

FIG. 1

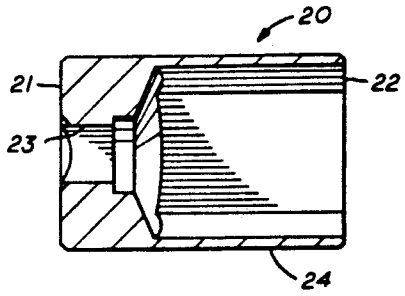

FIG. 2

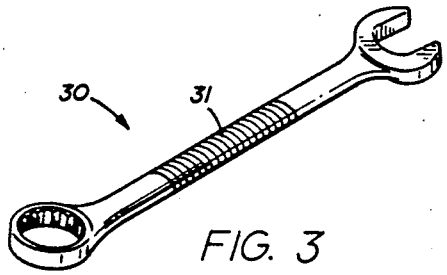

FIG. 3

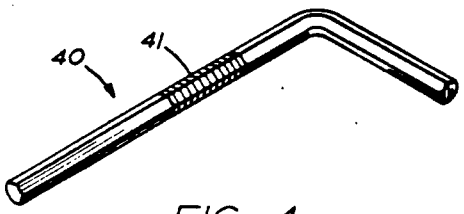

FIG. 4

FIG. 5

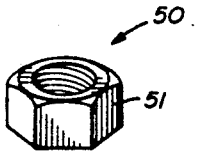

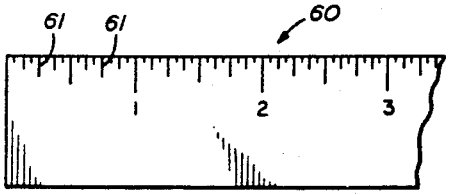

FIG. 6

FIG. 7

| DENOMINATOR | SIZE | COLOR |
|---|---|---|
| 16 | 1/16, 3/16, 5/16, 7/16, 9/16, 11/16, 13/16, 15/16, 1 1/16 | YELLOW |
| 8 | 1/8, 3/8, 5/8, 7/8, 1 1/8 | GREEN |
| 4 | 1/4, 3/4, 1 1/4 | BLUE |
| 2 | 1/2, 1 1/2 | RED |
| 1 (UNITS) | 1, 2, 3 | BLACK |

FIG. 8

| SIZE | SHADE | COLOR | SIZE | SHADE | COLOR | SIZE | SHADE | COLOR |
|---|---|---|---|---|---|---|---|---|
| 1 MM. | LIGHT | YELLOW | 11 MM. | LIGHT | YELLOW | 21 MM. | LIGHT | YELLOW |
| 3 MM. | " | GREEN | 13 MM. | " | GREEN | 23 MM. | " | GREEN |
| 5 MM. | " | BLUE | 15 MM. | " | BLUE | 25 MM. | " | BLUE |
| 7 MM. | " | PINK | 17 MM. | " | PINK | 27 MM. | " | PINK |
| 9 MM. | " | GREY | 19 MM. | " | GREY | 29 MM. | " | GREY |
| SIZE | SHADE | COLOR | SIZE | SHADE | COLOR | SIZE | SHADE | COLOR |
| 2 MM. | DARK | YELLOW | 12 MM. | DARK | YELLOW | 22 MM. | DARK | YELLOW |
| 4 MM. | " | GREEN | 14 MM. | " | GREEN | 24 MM. | " | GREEN |
| 6 MM. | " | BLUE | 16 MM. | " | BLUE | 26 MM. | " | BLUE |
| 8 MM. | " | RED | 18 MM. | " | RED | 28 MM. | " | RED |
| 10 MM. | " | BLACK | 20 MM. | " | BLACK | 30 MM. | " | BLACK |

COLOR CODING SYSTEM

This is a CIP of 07/386,345 filed Jul. 28, 1989, now U.S. Pat. No. 4,936,170.

BACKGROUND OF THE INVENTION

Implements, especially hand tools, come in an abundance of forms and sizes. For example, in addition to regular hand wrenches, there are socket, ratchet and set screw key (Allen Wrench) varieties. Each such tool comes in a variety of sizes. A worker may carry in his tool box a number of sizes of a number of different such implements.

While most hand tools have some operative size marked thereon, the actual size difference between tools may be so slight that the user may have to read the size on a number of objects to find the appropriate sized tool. Obviously, this takes time. This inventor determined that the presence of a color scheme applied to implements, including tools, fasteners, or measuring devices, could significantly reduce the amount of time necessary to select the properly sized instrument. A search performed revealed the following U.S. patents, none of which significantly approaches this invention: U.S. Pat. Nos. 3,127,986 3,749,233; 3,804,238; 3,910,412; 4,032,008; 4,155,446; 4,621,738; and 4,688,672. This application itself is a continuation in part of U.S. patent application Ser. No. 07/386,345, filed July 28, 1989.

SUMMARY OF THE INVENTION

This invention permits ready size discrimination by an implement user. A set of particular tools, the ignition wrench of FIG. 3 being an example, may have a number of differently sized pieces on each end. For example the jaw separation of the conventional wrench portion (the nominal size) approximates the width across flats of nuts or bolt heads with which the wrench is suited to be used. The nominal sizes of a kit may vary from ¼" to 2". As a simplistic example, assume that it is desirable to be able to quickly select a 1" conventional wrench. If all wrenches having a size of one or more exact inches were of the same color, a user could easily visually distinguish between the 1" and 2" wrenches. Likewise, if all such devices sized in multiples of ½", excepting those to the even inch, were of another color, again selectivity would be simple. The same concept may be applied to sizes having other like denominators. A further embodiment of particular applicability to implements calibrated by the metric system has been developed. All sizes having the same last digit, expressed in millimeters, may bear the same color. Hereinafter, the color coding system applicable to the English system of measurement, for example inches, will be referred to as the standard system.

DESCRIPTION OF THE DRAWINGS

FIG. 1 is a perspective of socket wrench;

FIG. 2 is a section taken along lines 2—2 of FIG. 1;

FIG. 3 a perspective of an ignition or combination wrench having oppositely disposed grip jaws and ratchet;

FIG. 4 is a perspective of an Allen Wrench or set screw key;

FIG. 5 is a perspective of a nut;

FIG. 6 is a broken elevation of a rule;

FIG. 7 is a chart for coordinating size and color with the standard system; and FIG. 8 is a chart for similarly coordinating size and color with the metric system of measurement.

DESCRIPTION OF A PREFERRED EMBODIMENT

The fundamental goal of this invention is to permit a worker to quickly select the properly sized tool. The term implement is more generic and is intended to include tools, instruments and utensils. This invention allows him to make such a selection from what may be a large collection of differently sized objects in his tool compartment or box. The invention has applicability to a variety of driving as well as driven elements.

Applicability to the metric system will be discussed hereinafter. Initial consideration is given to the English or standard system.

The crux of the invention comprises the provision of a scheme or system applying specific colors to implements, including tools, fasteners, or similar items, whose effective size varies by clearly defined increments. For example, consider the socket wrench 20 of FIGS. 1 and 2. Such devices typically have a driven portion 21 and a driving portion 22, herein shown to be of ratchet or sawtooth configuration. The driven portion 21, shown to have a square aperture 23 therein, would receive a shaft or handle, to cause rotation thereof. Driving or ratchet portion 22 may vary in size, let's say, from 1/16" to 1", in increments of 1/16", and above 1" in increments of 1". Such nominal size would generally refer to or have a relationship to a fastener such as a nut or bolt head intended to be rotated by the wrench. A specific color, black for example, would be applied to an obvious portion 24 of each socket wrench whose size is 1" or a multiple thereof. At the lower end of the size list, such a wrench having a 1/16" size might have its surface 24 colored yellow. Other sized wrenches having the same denominator, 16, and even numerator increments above "1", i.e., 3/16", 5/16", 7/16" . . . , would also be colored yellow. Likewise, wrenches so sized with the denominator "8", and numerators commencing with "1", and further even increments therefrom, i.e., 1/8", 3/8", 5/8" . . . , may be colored green. Similar treatment would be given sizes whose denominator is "4" or "2". The chart of FIG. 7 illustrates this concept. Such chart may be provided a user as a quick, easy learning tool. The same principal may be applied to the combination wrench 30 of FIG. 3, with the color code applied to a central section 31. Since each end may vary independently, separate color areas may be provided near each end. Likewise, Allen Wrench or set screw key 40 may come in a variety of sizes, with color coding applied at 41. As an additional illustration, nut 50 may have its color applied along one or more of its flats 51. Another example, a measuring instrument such as rule 60, may have its divisional markings, such as ¼", ¾", illustrated at 61, colored in the same sense as previously described, for quick coordination and determination of size.

Finally, consider the chart of FIG. 7 as illustrative of the mathematical basis of the color code explained previously. The denominator column is self illustrative. The size column depicts a limited number of sizes, wherein the numerator follows the formula 1, and thereafter 1+increments of 2. Finally, the color column specifies the color associated with each collection of sizes. Obviously, other denominator units, with their respective colors could be added. The actual size would likely be printed or stamped on each tool.

For use with metric system tools, could be used. For example, odd-unit sizes could be designated one color, and even-numbered ones given another, in simplistic fashions. Or, for standard sizes, such as 10 centimeter, 25 centimeter, or the like, similar color codes to those illustrated for non-metric tools could be applied.

A specific metric system color scheme is described as follows. The chart of FIG. 8 is illustrative. Basically, five hues or colors, such as yellow, green, blue, pink (or red) and grey (or black), are sufficient to adequately differentiate all commonly-sized metric implements. The last whole number digit determines the particular sub-group or set to which a particular color is applied. Most metric tools are sized in millimeters, 1–1000. The group comprising evenly sized tools are given darker shades of their respective hues or colors. On the other hand, the group of tools being odd sized may be assigned lighter shades. Thus the set including 1 mm, 21 mm, 71 mm would all have the same color identification, such as light yellow. Similarly, the tool set including those tools having the dimensions of 24 mm, 64 mm, or 94 mm would be of dark green hue. Should fractional dimensions in the metric system be necessary, the same scheme may be used. However, any time that a second code identification appears on an implement, a user would automatically know that the second code referred to such a metric fraction. Additional available indicia to specifically indicate the presence of a metric fraction, may include underlining the second color, applying it in a particular geometric form, such as a triangle or circle. Finally, since a user's tool box may include both standard and metric tools, one needs to readily differentiate the two systems. This may be readily accomplished by applying colors that present different visual impressions to standard implements from those applied to metric ones. For example, the intensity, or chroma, might be varied. Flat vs. glossy finishes may be used. A metallic or glistening finish may indicate the metric system, for example.

Thus, by comparing the charts of FIGS. 7 and 8, one may quickly verify that the color schemes described herein permit color identification of substantially any given size, and vice versa. The following are examples: (1) 5" flat black; (2) 16.9 mm metallic, dark blue, light black or grey.

In summation, by varying the intensity or visual impression of the colors applied, one such color intensity, or chroma, may indicate the general dimensional measuring system, and the other the metric system. Within the metric system, sizes, given in millimeters, for example, are divided into odds and evens, with different shades applied thereto, so as to distinguish therebetween. Finally, five colors, or hues, are used to distinguish the last whole digit. Those five colors, such as yellow, green, blue, pink (or red) and grey (or black) may be applied respectively to 1, 3, 5, 7 and 9, as well as respectively to 2, 4, 6, 8 and 0. The application to metric fractions has previously been described. Thus, by using five colors, and differentiating by intensity (or chroma), by shade, sometimes referred to as value, and by hue, a kind of universal applicability has been accomplished.

Although only a limited number of system embodiments has been illustrated, it should be obvious that numerous modifications would be possible by one skilled in the art without departing from the spirit of the invention, the scope of which is intended to be limited only by the following claims.

I claim:

1. In a collection of implements having a color coding arrangement, the improvement comprising:

said collection of implements includes a plurality of implement groups, each group having a plurality of sets of individual implements, each implement within a particular group having a size which bears a defined mathematical relationship to the size of every other implement within said particular group;

each said set includes a distinct color arrangement provided its implements, each said set color arrangement being different from that of each of the other implement sets.

2. The collection of implements of claim 1, wherein said defined mathematical relationship of one of said implement groups comprises all of said one group's implements having an odd-numbered size.

3. The collection of implements of claim 1, wherein said defined mathematical relationship of one of said implement groups comprises all of said one group's implements having an even-numbered size.

4. The collection of implements of claim 2, wherein said defined mathematical relationship of another of said implement groups comprises all of said another group's implements having an even-numbered size.

5. The collection of implements of claim 1 wherein each implement within a particular set has a size which bears a defined mathematical relationship to the size of every other implement within said particular set.

6. The collection of implements of claim 2 wherein each implement within a particular set has a size which bears a defined mathematical relationship to the size of every other implement within said particular set.

7. The collection of implements of claim 4 wherein each implement within a particular set has a size which bears a defined mathematical relationship to the size of every other implement within said particular set.

8. The collection of implements of claim 5 wherein each said set's defined mathematical relationship comprises the last whole number digit of the size of each of its implements being the same.

9. The collection of implements of claim 6 wherein each said set's defined mathematical relationship comprises the last whole number digit of the size of each of its implements being the same.

10. The collection of implements of claim 7 wherein each said set's defined mathematical relationship comprises the last whole number digit of the size of each of its implements being the same.

11. In a collection of implements having a color coding arrangement, the improvement comprising:

means for identifying metrically sized implements, said identifying means including;

said metrically sized implements including a first plurality of implement groups, each said group having a plurality of sets of individual implements, each implement within a particular one of said groups having a size which bears a defined mathematical relationship to the size of every other implement within said particular group, said relationship of one of said groups comprising all of said one group's implements having an odd-numbered size and said relationship of another one of said groups comprising all of said group's implements having an even-numbered size.

each said set including a distinct color arrangement provided its implements, each said set color arrangement being different from that of each of the other implement sets, each of the implements within each respective set having a size whose last whole number digit is the same as that of all of the other implements within said respective set, means for identifying non-metrically sized implements, said identifying means including a second plurality of implement groups, each of said second implement groups having a plurality of differently-sized, individual implements, each implement within one of said second implement groups having a size which bears a defined mathematical relationship to the size of every other implement within its respective second implement group, each said second implement group including a color arrangement provided its implements distinct from the color arrangements of all other second implement groups, and means for color differentiating said metrically sized implements from said non-metrically sized implements.

* * * * *